United States Patent [19]

Kan

[11] Patent Number: 4,706,486

[45] Date of Patent: Nov. 17, 1987

[54] JAW ASSEMBLY FOR STRETCH PRESS

[75] Inventor: Kwok-Ning S. Kan, Alhambra, Calif.

[73] Assignee: L & F Industries, Huntington Park, Calif.

[21] Appl. No.: 825,332

[22] Filed: Feb. 3, 1986

[51] Int. Cl.[4] ..... B21D 25/00

[52] U.S. Cl. ..... 72/302; 269/45; 269/152

[58] Field of Search ..... 72/302, 301, 296, 297, 72/295, 305, 466; 269/152, 266, 45

[56] References Cited

U.S. PATENT DOCUMENTS

| | | | |
|---|---|---|---|
| 2,609,860 | 9/1952 | Kindelberger | 72/296 |
| 2,747,644 | 5/1956 | Wheeler et al. | 72/296 |
| 2,753,915 | 7/1956 | Raynes | 72/297 |
| 2,824,594 | 2/1958 | Gray | 72/297 |
| 2,835,947 | 5/1958 | Gray et al. | 72/305 |
| 2,850,071 | 9/1958 | Kraybill | 72/297 |
| 3,073,373 | 1/1963 | Wheeler et al. | 72/297 |
| 3,299,688 | 1/1967 | Gray | 72/296 |
| 3,575,031 | 4/1971 | Gray | 72/302 |
| 3,595,057 | 7/1971 | MacKenzie | 72/302 |

*Primary Examiner*—Daniel C. Crane

*Attorney, Agent, or Firm*—Christie, Parker & Hale

[57] ABSTRACT

A jaw assembly for a stretch forming press is disclosed. The jaw assembly comprises a flexible jaw having a plurality of hingedly connected jaw segments mounted to a supporting jaw frame by means of three support pins so arranged as to distribute the loads from the part being formed into the support jaw frame through the three support pins.

26 Claims, 12 Drawing Figures

JAW ASSEMBLY FOR STRETCH PRESS

FIELD OF THE INVENTION

This invention relates to the art of stretch forming metal sheets and more particularly to a jaw assembly for a stretch forming press for gripping the edges of the metal sheet to be stretch formed.

BACKGROUND OF THE INVENTION

Stretch forming is a method of forming parts by stretching a metal sheet beyond its elastic limit over a die. The sheet is deformed by tension forces into a shape corresponding to the die, and retains this shape because it is stretched beyond its elastic limit. This method is widely used in aircraft and automotive fields for fabricating sheet metal components, and is further described in U.S. Pat. Nos. 2,824,594, 2,835,947, 3,073,373, 3,299,688 and 3,575,031.

In conventional stretch forming presses, a metal blank, typically flat aluminum or steel sheet stock having a generally rectangular shape, is loaded into a pair of opposed gripping jaws which are then positioned by associated tensioning hydraulic cylinders to an initial stretch forming position. A die carried by a main hydraulic cylinder is driven against the blank with sufficient force that the blank is stretched beyond its elastic limit over the die. Alternatively, the jaws are further moved by the tensioning cylinders to wrap the blank over the die. The blank is thereby formed into a desired shape which corresponds to the shape of the die.

The jaw assembly of such stretch forming presses may have a wide non-segmented jaw for gripping the end of the metal blank, or may have a multiple-segmented jaw. For example, in instances where the die has a straight contour transverse to the metal blank, it is desirable that the margins of the blank be gripped by a wide non-segmented jaw or by multiple-segmented jaw in which the segments are aligned in a straight line. When the die has a curved contour transverse to the metal blank, it is desirable to grip the ends of the workpiece with a plurality of jaw segments which can be moved relative to each other to follow the contour of the die.

In U.S. Pat. No. 2,835,947 to Gray et al, a jaw assembly is disclosed having four jaw segments. The jaw segments are mounted on a pair of spaced-apart platens which are in turn mounted on a single mount. The mount is connected by a shaft to a tensioning device for moving the jaw horizontally forwardly and rearwardly. The platens can be rotated relative to the mount. Each segment is pivotally coupled to adjacent segments and can rotate and move transversely within guideways in the platens. The jaw segments can be aligned in a straight line or one which curves downward on one or both sides.

U.S. Pat. No. 3,299,688 to Gray discloses a stretch forming press having a plurality of jaw segments wherein each segment is separately connected to a hydraulic cylinder and forms an independent tensioning unit. In such an apparatus, the position of the jaw segments is independently adjustable. A cable extends through the jaw segments to loosely maintain their relation to each other.

In another known multiple segment jaw assembly, the segments are simply hinged to each other with the center segment being connected to the tensioning device by means of a yoke and a rearwardly extending shaft. In such an assembly, the widths of the segments are generally equal, however, to provide adequate strength, the length of the center segment is greater than the next adjacent segments, whose lengths are greater than the next adjacent segments and so on.

In the above-mentioned stretch forming presses, the jaws assemblies are attached to the tensioning device at positions spaced apart rearwardly of their centers of gravity, in some instances by as much as 10 feet. This creates a substantial rotational moment on the point of attachment which must be compensated for, e.g., by stop pins or the like. Any upward swing of the jaw results in loss of die table stroke. Further, movement of the jaw segments relative to each other, e.g., to form a curve, generally causes a change in the center of pull which creates an additional rotational moment about the point of attachment of the jaw assembly to the tensioning device during stretch forming operation.

SUMMARY OF THE INVENTION

Accordingly, there is provided a jaw assembly for a stretch forming press comprising a jaw frame and a flexible jaw mounted on the jaw frame for gripping the edges of a metal blank. The jaw frame comprises a generally flat front wall having a pair of horizontally extending side slots spaced apart from and on separate sides of the midpoint of the front wall.

The flexible jaw comprises a plurality of jaw segments interconnected by means of hinges. The jaw is mounted on the frame by means of a pair of side support pins which extend rearwardly from the jaw into the side slots of the jaw frame. The side support pins are slidably secured within their respective slots.

Means, preferably hydraulic means, are provided for raising and lowering the center of the jaw. As the center of the jaw moves away from the elevation of the side support pins, the side support pins are caused to move horizontally inwardly along the length of the side slots resulting in curvature of the jaw. As the center of the jaw moves toward the elevation of the side support pins, the side support pins move horizontally outwardly along the lengths of the side slots.

The jaw assembly further comprises means for mounting the jaw frame between a pair of laterally spaced-apart jaw carriages of a stretch forming press. Preferred means comprise a pair of coaxial trunnions which extend laterally from the ends of the jaw frame at about the same elevation as the elevation of the side slots and which rotatably engage a pair of laterally spaced-apart jaw carriages of the stretch forming press. In such an arrangement, the center of pull of the jaw is always at about the elevation of the trunnions which minimizes any movement which could cause rotation about the trunnions. Means, preferably hydraulic means, are provided for rotating the jaw assembly about the axis of the trunnions.

In a preferred embodiment of the invention, the flexible jaw comprises a center support pin which extends rearwardly from the center of the jaw into a generally vertical center slot in the front wall of the jaw frame and a pair of side support pins which extend rearwardly from the jaw at positions spaced apart laterally from the center support pin and into side slots in the front wall of the jaw frame.

Vertical movement of the center support pin and hence, the center of the jaw is preferably controlled by a first hydraulic cylinder which is mounted on the frame at a position above the center support pin and is coupled to the center support pin. Second and third hydraulic cylinders are also provided for controlling pivotal movement of the end jaw segments. The second and third hydraulic cylinders are hingedly mounted to the top of the jaw at or about the center of the jaw, the piston rods of the second and third hydraulic cylinders extending outwardly to and being hingedly connected to separate end jaw segments. Activation of the first, second and/or third hydraulic cylinders controls the curvature of the jaw. Adjustable stops may be provided between adjacent jaw segments to further control the curvature of the jaw.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
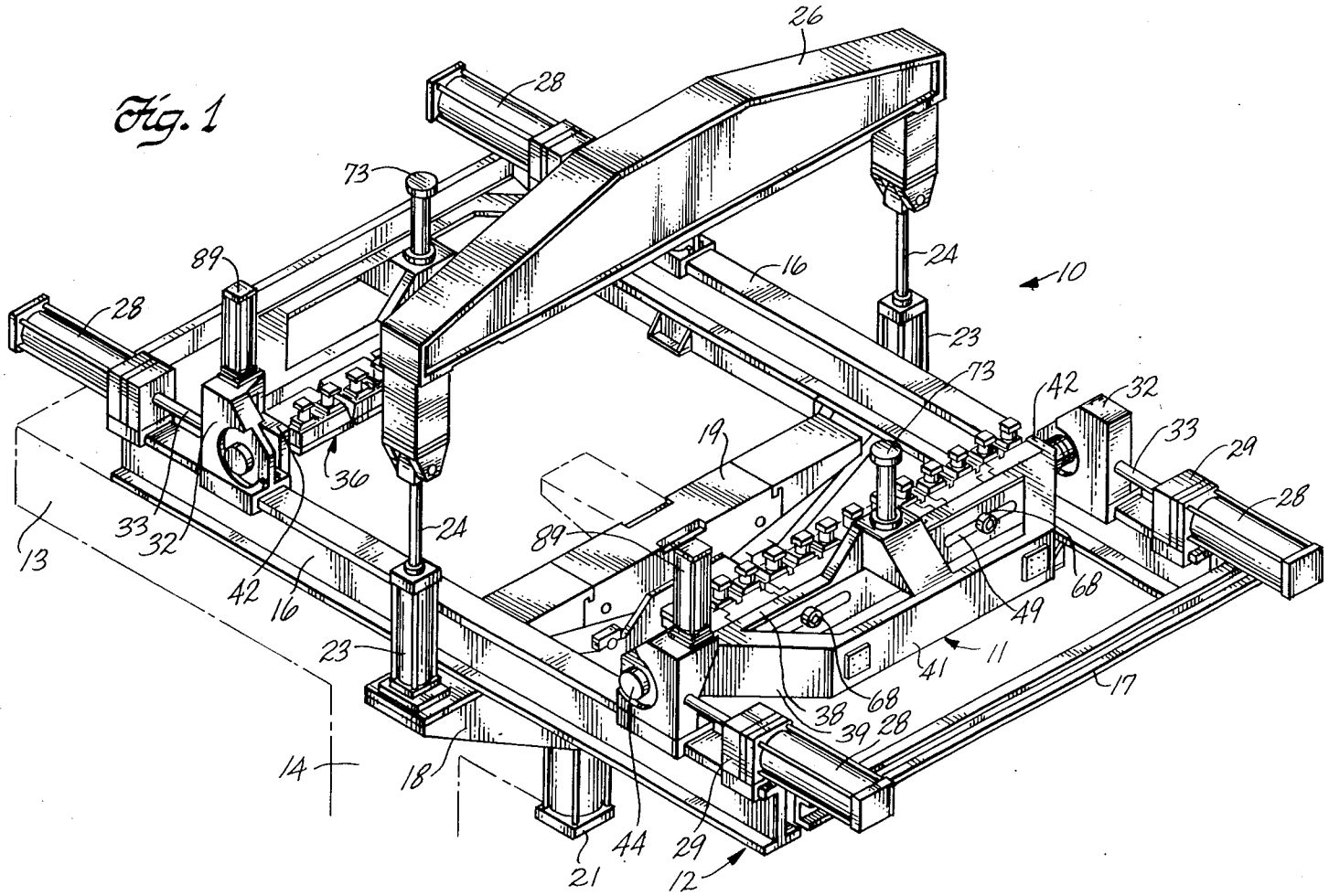
FIG. 1 is a perspective view of a preferred stretch forming press.

With reference to FIG. 1, there is shown a preferred stretch forming press 10 comprising a preferred jaw assembly 11 constructed in accordance with the present invention. The stretch forming press 10 comprises a base 12 which rests on a concrete or other solid foundation 13 forming a pit 14 below the level of the surrounding floor. The base 12 comprises a pair of elongated laterally spaced-apart horizontal I-beam 16 secured together at their ends by end plates 17.

A large lower die support 18 extends transversely below the base 12 of the stress press 10 within the pit 14. The lower die support 18 is fixedly attached at positions adjacent its ends to the beams 16 generally about the midpoint of the beams. A vertically movable die table 19 for supporting a die (not shown) is positioned over the lower die support 18. A pair of hydraulic cylinders 21 are mounted on the underside of lower die support 18 with the piston rods (not shown) of hydraulic cylinders 21 extending upwardly through the lower die support for connection to the bottom side of the die table 19. Activation of hydraulic cylinders 21 controls vertical movement of die table 19.

Lower die support 18 extends laterally beyond the beams 16. A pair of vertically extending hydraulic cylinders 23 are mounted on the ends of lower die support 18 which extend beyond the beams 13. The piston rods 24 of hydraulic cylinders 23 extend upwardly and are pivotally connected at their upper ends to the lateral ends of an upper die support 26 which extends transversely across the stretch forming press 10. An upper die (not shown) can be mounted on upper die support 26 which can then be moved vertically relative to lower die support 18 and die table 19 by activation of hydraulic cylinders 23.

The stretch forming press 10 further comprises four main tension hydraulic cylinders 28 which are clamped at the ends of beams 16 by means of brackets 29. A jaw carriage 32 is slidably mounted on beam 16 in front of each main tension cylinder 28 and is connected to the forward end of a piston rod 33 of main tension cylinder 28. Activation of main tension cylinders 28 causes jaw carriages 32 to move forwardly or rearwardly along the length of horizontal beams 16. The jaw assembly 11 is rotatably mounted on and extends between two jaw carriages 32 at each end of stretch forming press 10.

Figure 2:
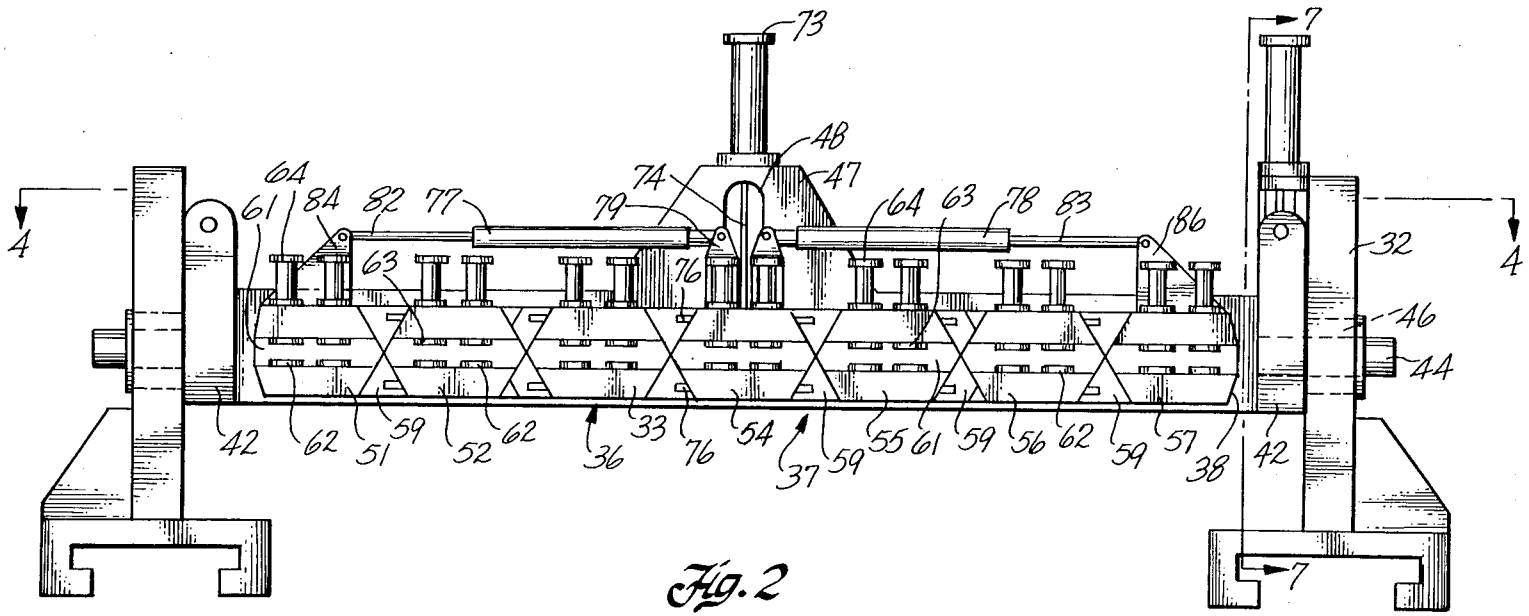
FIG. 2 is a front view of a preferred jaw assembly mounted on a pair of jaw carriages.
Figure 3:
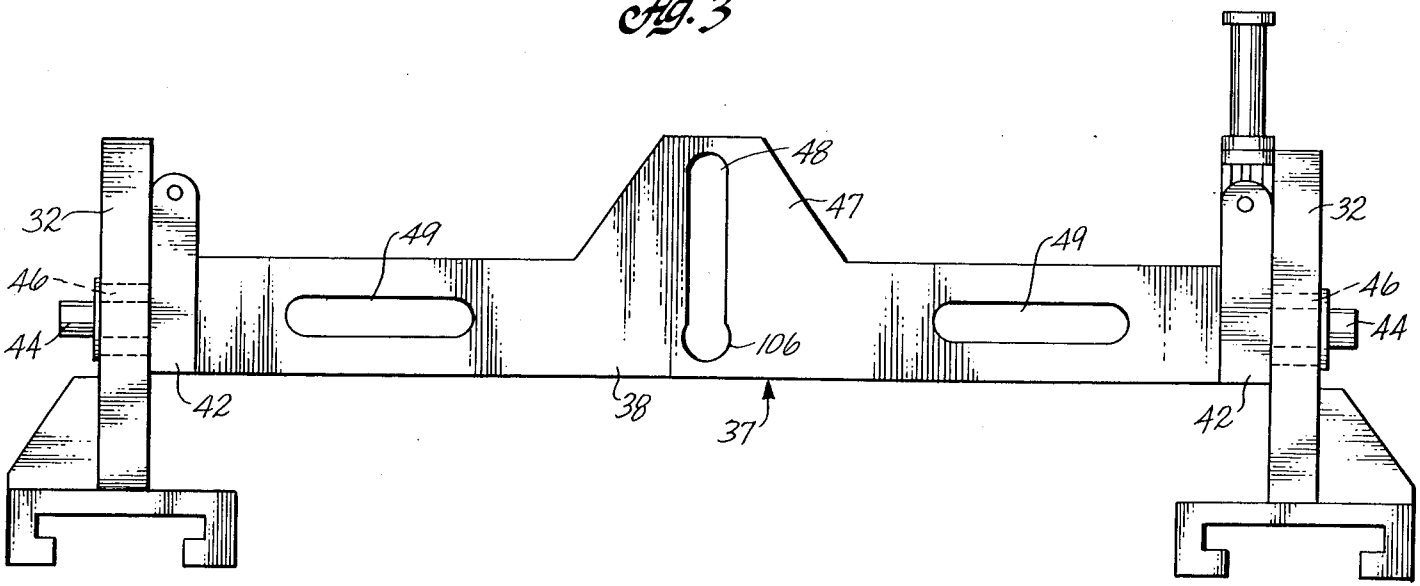
FIG. 3 is a front view of the jaw frame of the jaw assembly shown in FIG. 2.
Figure 4:
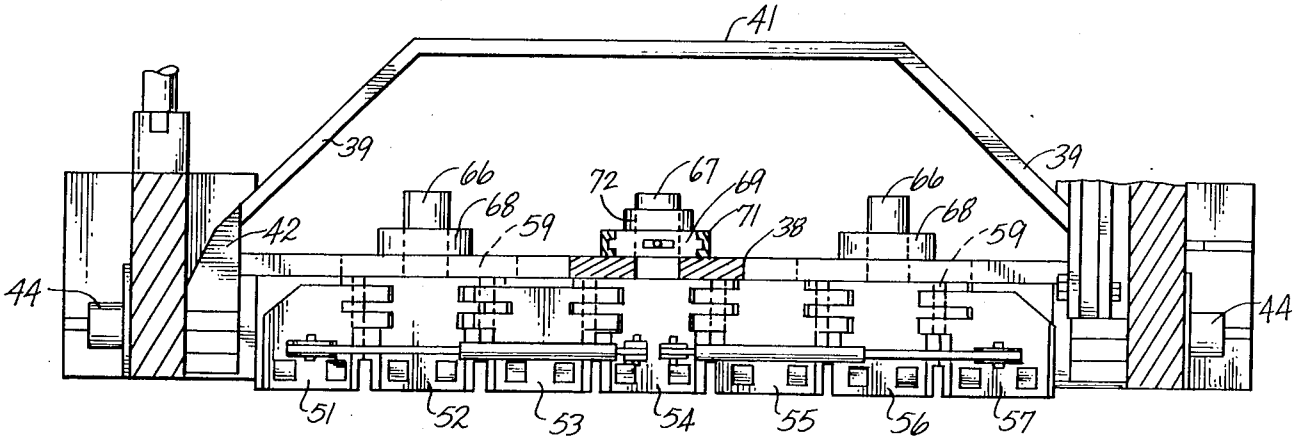
FIG. 4 is a fragmentary top cross-sectional view of the jaw assembly shown in FIG. 2 through line 4—4.
Figure 5:
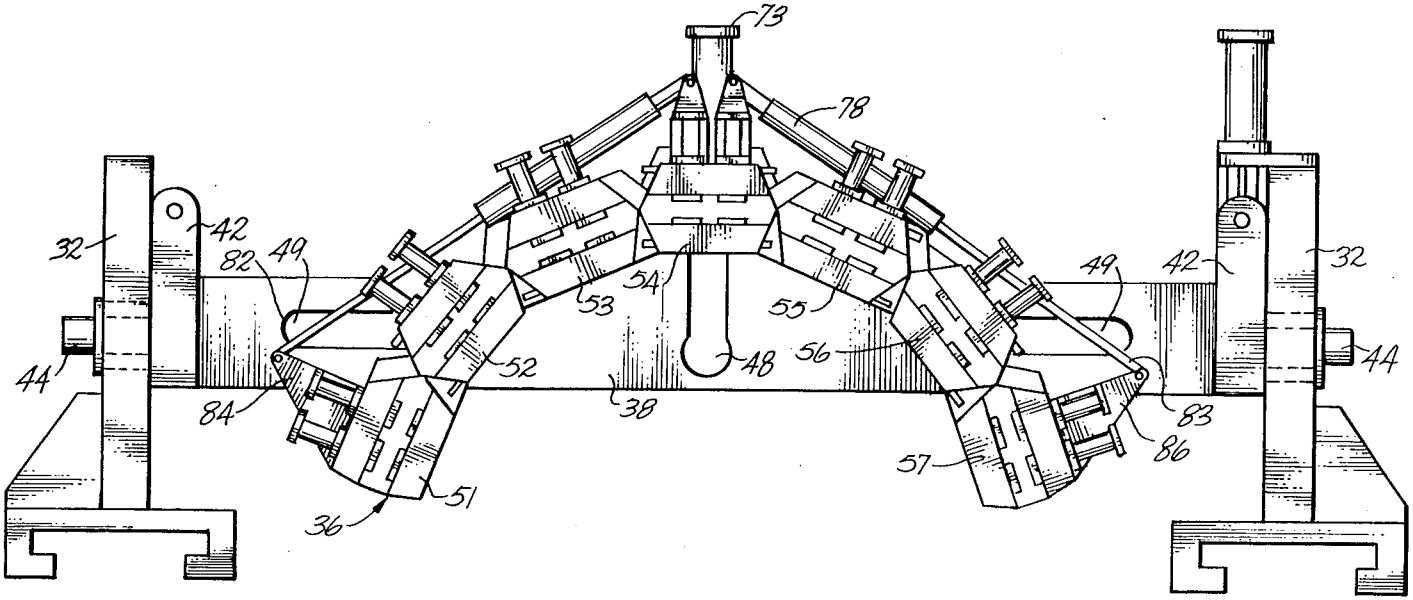
FIG. 5 is a front view of the jaw assembly shown in FIG. 2 in a curved configuration.

With reference to FIGS. 2–6, the jaw assembly 11 comprises a flexible jaw 36 which is mounted on a jaw frame 37. The jaw frame 37, as shown in FIG. 4, comprises a generally flat vertical front wall 38, a pair of side walls 39 which extend rearwardly and inwardly from the front wall 38 and a rear wall 41 generally parallel to the front wall 38.

Front wall 38 of the jaw frame 37 defines three slots (FIG. 3), a generally vertical center slot 48 and a pair of generally horizontal side slots 49 spaced apart on opposite sides of center slot 48. Center slot 48 extends from a lower end about the elevation of side slots 49 to an upper end above the elevation of side slots 49. In the embodiment shown, front wall 38 has a raised center section and is generally in the form of an inverted "T". It is to be understood that the shape of the front wall is not restricted to the shape shown in the drawings but may be any suitable shape.

Jaw frame 37 further comprises a pair of supporting end walls 42 which extend forwardly at the ends of front wall 38. A pair of generally coaxial, horizontal trunnions 44 extend laterally outwardly from end walls 42 and engage bearings 46 in jaw carriages 32. Jaw assembly 11 is thus afforded rotatable movement about the horizontal axis of trunnions 44. Trunnions 44 are at about the same level as side slots 49 and are located at positions whereby the axis of trunnions 44 passes through about the center of mass of the jaw assembly.

Jaw 36 comprises seven jaw segments 51–57 respectively which are hingedly connected together by pivot pins 59 (FIG.4). The jaw segments are all generally the same, each comprising a mouth 61 which opens forwardly to receive and grip the edge or margin of a metal blank. The metal blank is gripped by means of a pair of stationary lower gripping inserts 62 on the floor of mouth 61 and a pair of movable upper gripping inserts 63 spaced apart above lower gripping inserts 62. Movement of upper gripping inserts 63 is controlled by a pair of hydraulic cylinders 64 mounted on the top of each jaw segment. The piston rod (not shown) of each hydraulic cylinder 64 extends downwardly through the jaw segment and is connected to the tops of upper gripping inserts 63.

Jaw 36 is mounted on jaw frame 37 by means of three generally cylindrical support pins, a pair of side support pins 66 and a center support pin 67 (FIG.4). Center support pin 67 extends rearwardly from the center or fourth jaw segment 54 through center slot 48. It also extends through a generally circular opening in a center support pin carriage 69 located behind front wall 38. The vertical edges of center support pin carriage 69 are slidably disposed in generally vertical tracks 71 behind front wall 38 on each side of center slot 48.

A retaining ring 72 having a diameter greater than the opening in center support pin carriage 69 is fixedly mounted on center support pin 67 at a position behind center support pin carriage 69. Center support pin 67 and center support pin carriage 69 are afforded vertical slidable movement along the length of center slot 48 and track 71. Center support pin 67 is also afforded rotatable movement relative to center slot 48 and center support pin carriage 69.

Figure 6:
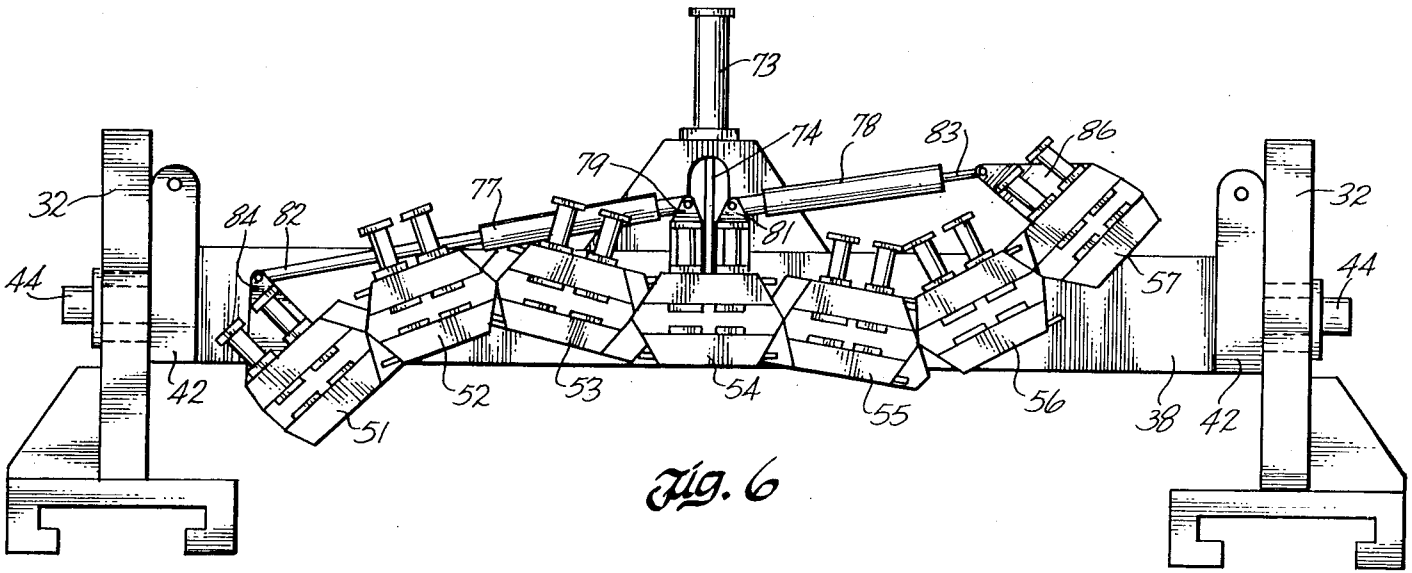
FIG. 6 is a front view of the jaw assembly shown in FIG. 2 in an "S" configuration.

Center support pin 67 and hence center jaw segment 54 are afforded vertical movement along the length of center slot 48 from a lower position at the lower end of the center slot 48 as shown in FIG. 2 wherein the jaw segments are all aligned in a straight horizontal row to an upper position at the upper end of center slot 48 as shown in FIG. 6 wherein the jaw segments form an arch.

Side support pins 66 extend horizontally rearwardly from second and sixth jaw segments 52 and 56 respectively through side slots 49 of front wall 38 of jaw frame 37. The diameters of side support pins 66 are slightly less than the widths of side slots 49 so that side support pins 66 can slide and rotate within side slots 49. A pair of retaining rings 68 having diameters greater than the widths of side slots 49 engages side support pins 55 at positions behind front wall 38 of jaw frame 37. Retaining rings 68 are fixedly mounted on side support pins 66 at positions which afford side support pins 66 horizontal slidable and rotatable movement within side slots 49.

In this arrangement, the center of pull of the jaw is at about the level of the axis of the trunnions 44 when the jaw segments are aligned in a straight row. That is, the center of pull passes through the jaw assembly at about the axis of trunnions 44. As used herein "center of pull" refers to the line or vector at the center of the forces acting on a metal blank by the jaw.

In addition, the precise location of side support pins 66 on second and sixth jaw segments 52 and 56 is preferably selected so that, for a metal sheet approximately the same width as the width of the jaw, change in the center of pull of the jaw does not occur, or is at least minimized, when the jaw is moved to a different configuration when the center jaw segment is raised.

Movement of center jaw segment 54 is controlled by a hydraulic cylinder 73 mounted on the top of front wall 38 of jaw frame 37 directly above center support pin carriage 69. The piston rod 74 of hydraulic cylinder 73 extends downwardly and is connected to center support pin carriage 69. Activation of hydraulic cylinder 73 results in vertical movement of center support pin carriage 69 which also results in vertical movement of center support pin 67 and center jaw segment 54.

Because the jaw segments are hingedly interconnected by pivot pins 59, movement of center jaw segment 54 results in movement of the remaining jaw segments. For example, upward movement of center jaw segment 54 causes third and fifth jaw segments 53 and 55 to rotate and to move upwardly and inwardly, i.e., toward the midpoint of front wall 38. Second and sixth jaw segments 52 and 56 move horizontally toward the midpoint of front wall 38, vertical movement being restricted by side support pins 66 and side slots 49. Second and sixth jaw segments 52 and 56 also rotate about the axis of side support pins 66.

The extent of the rotation of the various jaw segments is controlled by means of adjustable stop pins 76 located between adjacent jaw segments. Stop pins 76 control the maximum angle which can be obtained between adjacent jaw segments.

The first and seventh or end jaw segments 51 and 57 also move inwardly as a result of upward vertical movement of the center jaw segment 54. However, rotatable movement of first and seventh jaw segments 51 and 57 cannot be controlled solely by the movement of center jaw segment 54 and by stop pins 76.

Rotatable movement of the first and seventh jaw segments 51 and 57 is controlled by hydraulic cylinders 77 and 78 respectively which are hingedly attached to center jaw segment 54 by brackets 79 and 81. The piston rods 82 and 83 of hydraulic cylinders 77 and 78 extend to and are hingedly connected to brackets 84 and 86 mounted on top of first and seventh jaw segments 51 and 57 respectively. Hydraulic cylinders 77 and 78 can be activated independently of each other and independently of hydraulic cylinder 73 which controls vertical movement of center jaw segment 54. For example, by activating hydraulic cylinder 77 to extend piston rod 82 and by activating hydraulic cylinder 78 to retract piston rod 83, the jaw can be made to form the shape of an "S" as shown in FIG. 6.

In FIGS. 2-6, the jaw assembly is in a horizontal orientation wherein the direction of pull on a metal blank gripped by the jaw segments along a horizontal line and the face of front wall 38 of jaw frame 37 is generally vertical. Jaw assembly 11, however, can be rotated about the axis of trunnions 44 to other orientations, i.e., orientations wherein the direction of pull is other than horizontal by means of a jaw rotating assembly.

Figure 7:
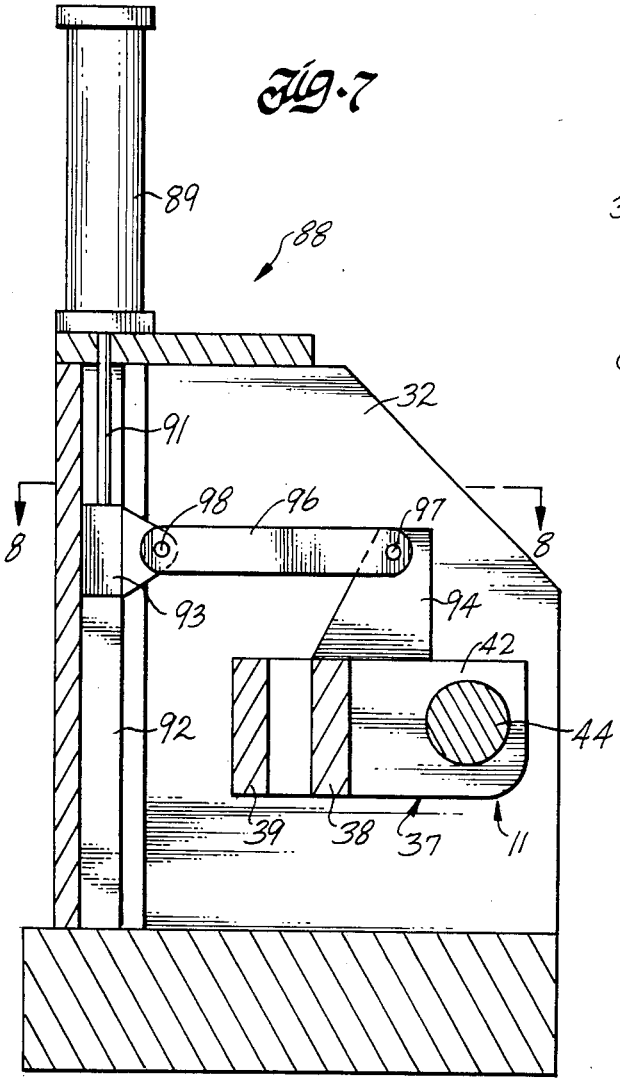
FIG. 7 is a side cross-sectional view of the jaw angle assembly of the jaw assembly of FIG. 2 through line 7—7.

With reference to FIG. 7, a preferred jaw rotating assembly 88 comprises a hydraulic cylinder 89 mounted on one of the jaw carriages 32 at a location above and rearward of trunnion 44 which engages that jaw carriage 32. The piston rod 91 of the hydraulic cylinder extends downwardly between the sides of a generally vertical track 92 fixedly attached to or integral with jaw carriage 32. The lower end of piston rod 91 engages a sled 93 slidably disposed in the track 92. Activation of hydraulic cylinder 89 results in vertical movement of sled 93 along the length of track 92.

The jaw rotating assembly 88 further comprises a bracket 94 which is fixedly mounted at the top of end wall 42 of jaw frame 37 adjacent the jaw carriage 32 and linkage 96 which is pivotally connected at its forward end to bracket 94 by means of a first pivot pin 97 and pivotally connected at its rearward end to sled 93 by means of a second pivot pin 98.

In this arrangement, activation of hydraulic cylinder 89 resulting in downward movement of sled 93 results in rotation of jaw assembly 11 in one direction, e.g., counterclockwise, when observing jaw assembly 11 from the view shown in FIG. 7. Upward movement of sled 93 results in rotation of the jaw assembly in the opposite direction.

In addition to providing a means for rotating the jaw assembly, the jaw rotating assembly provides an effective lock for the jaw assembly which prevents rotation. When a metal blank is stretched over a die, it creates an upward force at the front of jaw assembly 11 which tends to rotate jaw assembly 11 in the direction of the force, e.g., counterclockwise in the view shown in FIG. 7. Such rotational movement would result in rearward movement of linkage 96 which in turn would result in vertical movement of the sled 93. However, movement of the sled 93 is prevented by hydraulic cylinder 89. In such an arrangement, the hydraulic cylinder 89 carries some load, but the load is far less than that resulting in an arrangement wherein the hydraulic cylinder is connected directly to the jaw frame.

The load which is carried by the hydraulic cylinder depends on the angle of the linkage 96 from horizontal. That is, the closer the linkage 96 is to horizontal, the less the load on the hydraulic cylinder 89. At horizontal, the load on the hydraulic cylinder 89 is essentially zero. That is, when jaw assembly 11 is in its horizontal position, linkage 96 is also in a horizontal position and rotation of the jaw assembly 11 would translate into horizontal rearward movement of linkage 96. However, such rearward horizontal movement of linkage 96 is prevented by jaw carriage 32 which is stationary and sled 93 which can only move vertically along track 92 in jaw carriage 32. With no vertical component in the direction of linkage 96 movement, the sled 93 will not move. Thus, in its horizontal position, linkage 96 acts as a brace which prevents rotation of jaw assembly 11 and there is essentially no load on the hydraulic cylinder 89.

Figure 8:
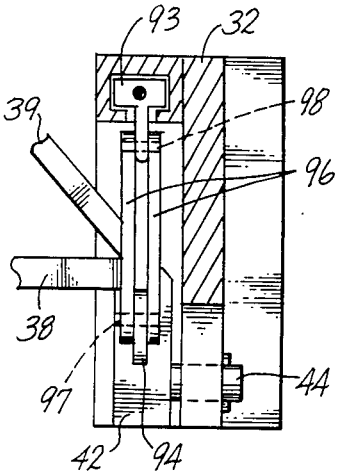
FIG. 8 is a top cross-sectional view of the jaw angle assembly of FIG. 7 taken through line 8—8.
Figure 9:
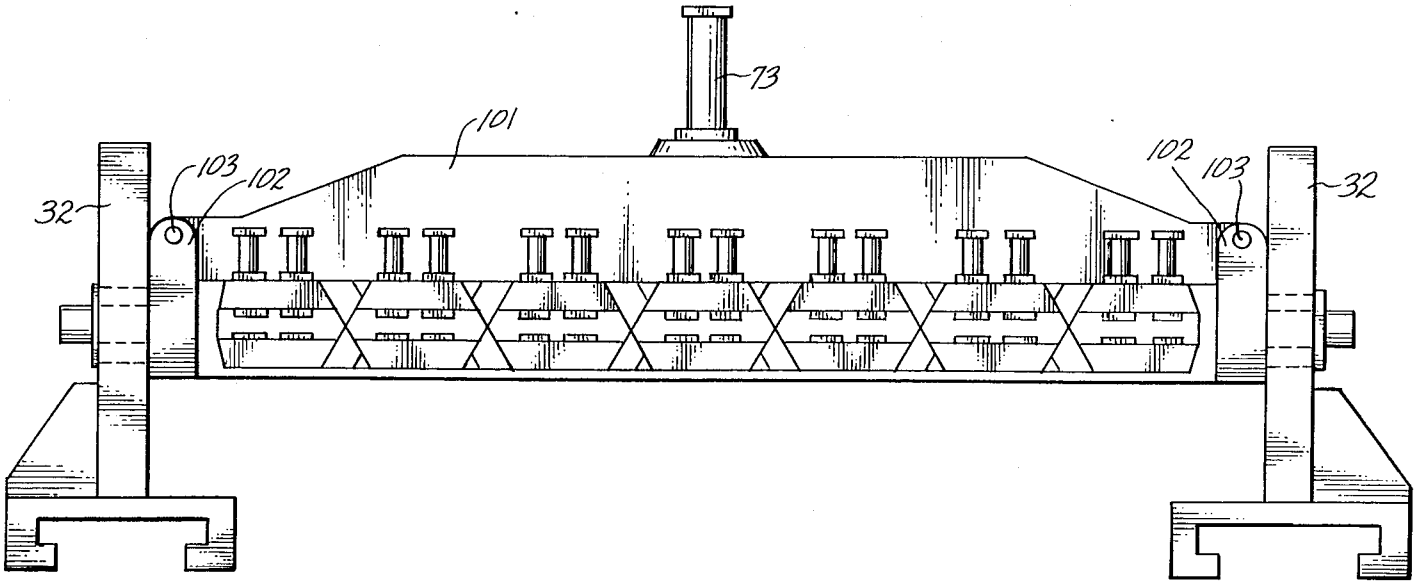
FIG. 9 is a front view of a preferred jaw assembly comprising a hold-down bar.

In a particularly preferred embodiment of the invention, as shown in FIG. 9, jaw assembly 11 comprises a removable hold-down bar 101 which is mounted at its ends to brackets 102 on end walls 42 of jaw frame 37 by bracket pins 103. Hold-down bar 101 extends transversely across the tops of jaw segments 51–57 and prevents upward movement of the jaw segments. It is apparent that the hold-down bar may be straight as shown in FIG. 8 or may be curved to maintain the jaw segments in a specific curvature.

Figure 10:
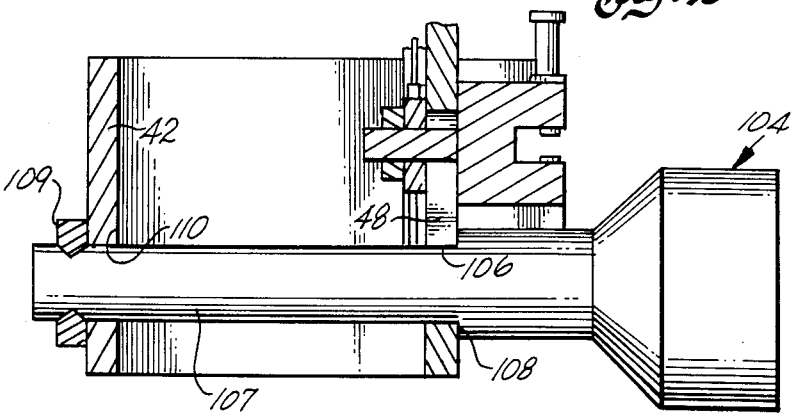
FIG. 10 is a side cross-sectional view of a preferred jaw assembly on which an auxiliary jaw is mounted.

In another particular preferred embodiment of the invention, an auxiliary jaw is mounted on the jaw frame, preferably at a position so that the center of mass of the jaw assembly remains the same and the center of pull of the auxiliary jaw is at the same elevation as the trunnions. For example, with reference to FIG. 10, there is shown a conventional extrusion jaw 104 mounted on jaw frame 37. So that extrusion jaw 104 may be mounted at the same elevation as trunnions 44, jaw 36 is moved to its upper position (see also FIG. 5). In the exemplary embodiment shown, front wall 38 has an enlarged circular opening 106 (shown in FIGS. 3 and 5) at the lower end of center slot 48 at about the level of trunnions 44. Extrusion jaw 104 has a generally cylindrical shaft 107 having a diameter larger than the width of center slot 48 which extends through the opening 106 in front wall 38 until a shoulder 108 at the forward end of the shaft abuts front wall 38. Because the diameter of shaft 107 is larger than the width of center slot 48, vertical movement of shaft 107 is prevented. The rearward end of shaft 107 extends through an opening 110 in rear wall 41 of jaw frame 37 and a retaining ring 109 is mounted on the rearward end of shaft 107 to prevent lengthwise movement of the shaft through the openings. In such an arrangement, the center of pull of auxiliary jaw 104 is at the level of trunnions 44.

With the above-described jaw assembly, the center of pull will not change significantly when the jaw is curved as long as the metal sheet has a width about the same as the width of the jaw. However, with metal sheets having widths less than the width of the jaw, the change in the center of pull may be significant. Accordingly, in another particularly preferred embodiment of the invention, the horizontal side slots are incorporated in a pair of vertically movable side mounting blocks mounted on the frame.

Figure 11:
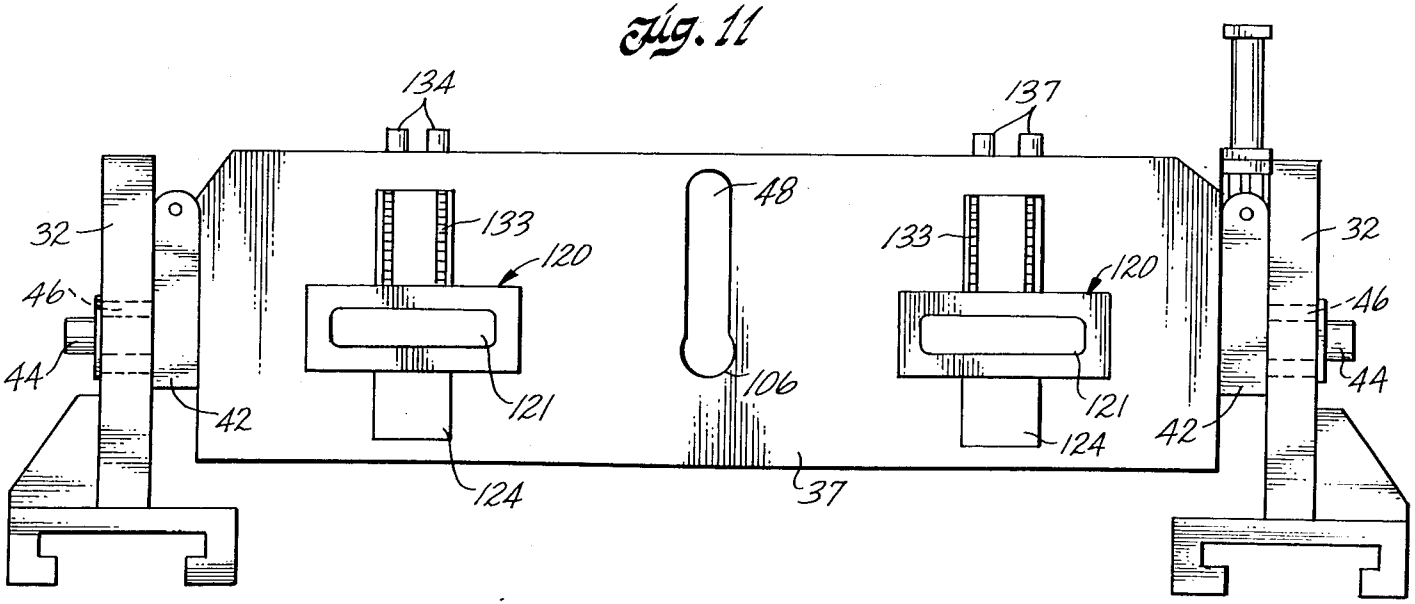
FIG. 11 is a front view of a preferred jaw frame on which side mounting blocks are mounted.
Figure 12:
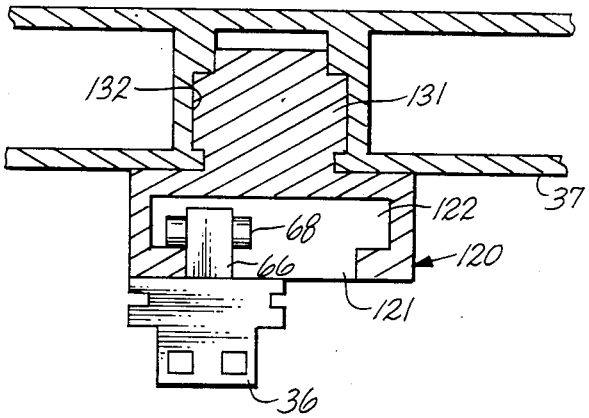
FIG. 12 is a top cross-sectional view of the jaw frame of FIG. 11 taken through line 12—12.

With reference to FIGS. 11 and 12, the side mounting block 120 comprises a generally rectangular front face having a generally horizontal front slot 121 generally the same as the horizontal side slots 49 of FIG. 3, through which the side support pin 66 of the jaw 36 extends. Rearward of the front slot 121 is a generally horizontal rear slot 122 having a width and length greater than that of the front slot 121. The side support pins 66 of the jaw 36 extend through and are afforded slidable horizontal movement within the front slot 121. Retaining rings 68 are fixedly mounted on the ends of the side support pins 66 which extend into the rear slot 122 and are afforded horizontal slidable movement within the rear slot 122. The retaining rings 68 have a diameter larger than the width of the front slot 121 and thereby secure the jaw to the side mounting block 120.

The side mounting block 120 is mounted in a generally vertical side slot 124 in the jaw frame 37. The side mounting block comprises a pair of vertically extending side rails 131 which extend laterally into and afforded vertical movement within a pair of generally vertical tracks 132 in the jaw frame 37.

The vertical position of the side mounting blocks 120 can be adjusted along the length of the vertical side slots 124 by means of adjusting screws 133. The adjusting screws 133 extended from gear drives 134 mounted on the top of the jaw frame 37 above the side mounting blocks 120 to the top of the side mounting block 120. Activation of the gear drives 134 rotates the adjusting screws 133 resulting in vertical movement of the side support blocks 120 and hence vertical movement of the jaw segment mounted on the side mounting block 120.

The gear drives 134 for the two side mounting plates 120 are preferably independently controlled so that the vertical positions of the two side mounting plates 120 can be independently adjusted. This enables a wider variety of jaw configurations.

The jaw assembly of the present invention provides several unique advantages. For example, because the jaw is mounted on the frame by means of three support pins rather than a single supporting shaft, a smaller, lighter and consequently less expensive jaw frame can be utilized.

Further, because the center of mass of the jaw assembly is at about the axis of the trunnions, there is essentially no moment of rotation which must be compensated for, e.g., by stop pins or the like, due to an unbalanced distribution of weight. Also, for a metal sheet having a width about equal to the width of the jaw, center of pull will remain substantially the same no matter what shape or curvature the jaw is in. This eliminates or at least minimizes the rotational moment or torque which rotates the jaw assembly about the trunnions when the center of pull is not at the same level as the trunnions. This latter feature also allows for a greater jaw curvature than the conventional multiple segmented jaws.

For metal sheets having a width smaller than the width of the jaw, changes in the center of pull may be avoided by incorporating vertically movable side support blocks into the jaw assembly. Such a feature provides the additional advantage of enabling the operator to simulate rotation of the jaw to some degree. This can be accomplished, for example, by adjusting the vertical position of one side mounting plate upwardly and that of the other side mounting plate downwardly.

The present invention also provides the unique advantage that auxiliary jaws can be mounted on the jaw frame without removal of the existing multi-segmented jaw. Further, auxiliary jaws can be selected so that the center of mass of the jaw assembly will not change and that the center of pull will remain at the same level as the trunnions.

The preceding description has been presented with reference to the presently preferred embodiments of the invention shown in the accompanying drawings. Workers skilled in the art and technology to which this invention pertains will appreciate that alterations and changes in the described apparatus and structure can be practiced without meaningfully departing from the principles, spirit and scope of this invention.

For example, it is apparent that the number of jaw segments may vary. While it is preferred that an odd number of jaw segments be used, jaws having an even number of jaw segments may be used. When such a jaw is used, the center support pin will preferably extend rearwardly from the hinge connecting the two center jaw segments together.

While preferred, it is apparent that a center slot and center support pin need not be used. In such an embodiment, the hydraulic cylinder which raises and lowers the center of the jaw may be connected directly to the jaw.

It is also apparent that the individual jaw segments may vary in size and shape as desired. Likewise, the support pins need not be of the same size to support the same load. If the side support pins are located on the end jaw segments, movement of the entire jaw may be controlled by a single hydraulic cylinder which raises and lowers the center of the jaw.

If desired, the center slot may extend below the level of the side slots. In such an embodiment, the jaw can be curved in the shape of a "U".

It is apparent that in addition to the extrusion jaw mentioned above, numerous other types of auxiliary jaws can be mounted on the jaw frame.

Accordingly, the foregoing description should not be read as pertaining only to the precise structures and techniques described, but rather should be read consistent with and as support for the following claims which are to have their fullest fair scope.

What is claimed is:

1. A jaw assembly for a stretch forming press comprising:

a jaw frame comprising a horizontally elongated front wall having a pair of generally horizontal side slots spaced apart on separate sides of the midpoint of the front wall the slots being fixed relative to one another;

a flexible jaw mounted on the front wall of the jaw frame comprising:

a plurality of jaw segments aligned in a row;

hinge means pivotally connecting adjacent jaw segments together;

a pair of side support pins extending rearwardly from the jaw at positions laterally spaced apart from and on separate sides of the midpoint of the jaw, each side support pin extending through a side slot of the jaw frame; and means for slidably and rotatably securing the side support pins in the side slots;

means for raising and lowering the center of the flexible and jaw relative to the jaw frame thereby causing said side support pins to rotate and slide within said slots, and means for mounting the jaw assembly on a stretch forming press.

2. A jaw assembly as claimed in claim 1 wherein the stretch forming press comprises a pair of laterally spaced-apart jaw carriages and wherein the means for mounting the jaw assembly on the stretch forming press comprises a pair of generally coaxial trunnions which extend horizontally outwardly from the lateral ends of the jaw frame rotatably engaging the jaw carriages.

3. A jaw assembly as claimed in claim 2 wherein the side slots are at about the same elevation and the trunnions are at about the same elevation as the elevation of the side slots.

4. A jaw assembly as claimed in claim 3 wherein the center of mass of the jaw assembly is at about the axis of the trunnions.

5. A jaw assembly as claimed in claim 1 wherein the means for raising and lowering the center of the jaw comprises a hydraulic cylinder mounted on the jaw frame at a position above about the center of the jaw, the piston rod of the hydraulic cylinder extending downwardly to the center of the jaw and being connected thereto.

6. A jaw assembly as claimed in claim 1 wherein the side support pins extend rearwardly from the jaw at locations which substantially minimize the change in the center of pull of the jaw when the center of the jaw is raised or lowered.

7. A jaw assembly as claimed in claim 1 further comprising means for independently rotating the jaw segments at the lateral ends of the jaw relative to their adjacent jaw segments.

8. A jaw assembly as claimed in claim 1 further comprising a hold-down bar removably secured to the jaw frame and extending across the tops of the jaw segments to prevent upward movement of the jaw segments.

9. A jaw assembly as claimed in claim 1 wherein the front wall of the jaw frame further comprises a generally vertical center slot at about the midpoint of the front wall and wherein the jaw further comprises a center support pin which extends rearwardly from about the midpoint of the jaw through the center slot of the frame and wherein the jaw assembly further comprises means for slidably and rotatably securing the center support pin in the center slot.

10. A jaw assembly as claimed in claim 9 wherein the means for raising and lowering the center of the jaw comprises a hydraulic cylinder mounted on the jaw frame at a position above the center support pin, the piston rod of the hydraulic cylinder extending downwardly to the center support pin and being connected thereto.

11. A jaw assembly mountable on a stretch forming press having a pair of laterally spaced-apart jaw carriages, said jaw assembly comprising:

a jaw frame comprising:

a horizontally elongated front wall having a generally vertical center slot and a generally horizontal side slot on each side of the center slot, the side slots being generally at about the same elevation;

an end wall extending forwardly from each lateral end of the front wall; and a pair of generally coaxial horizontal trunnions which extend laterally outwardly from separate end walls rotatably engaging the jaw carriages;

a flexible jaw mounted on the front wall of the jaw frame comprising:

a plurality of jaw segments aligned in a row;

hinge means pivotally connecting adjacent jaw segments together;

a center support pin extending rearwardly from the center of the jaw through the center slot of the jaw frame;

means for slidably and rotatably securing the center support pin in the center slot;

a pair of side support pins extending rearwardly from the jaw at locations laterally spaced apart from and on separate sides of the center support pin, each side support pin extending through a side slot of the jaw frame and wherein the locations of the side support pins are selected to substantially minimize the change in the center of pull of the jaw when the center support pin is raised or lowered; and means for slidably and rotatably securing the side support pins in the side slots; and means for raising and lowering the center support pin along at least a portion of the length of the center slot.

12. A jaw assembly as claimed in claim 11 wherein the trunnions are at about the same elevation as the elevation of the side slots.

13. A jaw assembly as claimed in claim 11 wherein the center of mass of the jaw assembly is at about the axis of the trunnions.

14. A jaw assembly as claimed in claim 11 wherein the means for raising and lowering the center support pin comprises a hydraulic cylinder mounted on the jaw frame at a position above the center support pin, the piston rod of the hydraulic cylinder extending downwardly to the center support pin and being connected thereto.

15. A jaw assembly as claimed in claim 11 further comprising means for independently rotating the jaw segments at the lateral ends of the jaw relative to their adjacent jaw segments.

16. A jaw assembly as claimed in claim 11 further comprising a hold-down bar removably secured to the end frame and extending across the tops of the jaw segments to prevent upward movement of the jaw segments.

17. A stretch forming press comprising:

a pair of laterally spaced-apart jaw carriages;

a jaw assembly extending between and rotatably mounted on the jaw carriages comprising:

a jaw frame comprising:

a horizontally elongated front wall having a generally vertical center slot and a generally horizontal side slot on each side of the center slot, the side slots being at about the same elevation;

an end wall extending forwardly from each lateral end of the front wall; and a pair of generally coaxial horizontal trunnions, each trunnion extending laterally outwardly from a separate end wall and rotatably engaged to the jaw carriages;

a flexible jaw mounted on the front wall of the jaw frame comprising:

a plurality of jaw segments aligned in a row;

hinge means pivotally connecting adjacent jaw segments together;

a center support pin extending rearwardly from the center of the flexible jaw through the center slot of the jaw frame;

means for slidably and rotatably securing the center support pin in the center slot;

a pair of side support pins extending rearwardly from the jaw at locations laterally spaced apart from and on separate side slots of the center support pin, each side support pin extending through a side slot of the jaw frame; and means for slidably and rotatably securing the side support pins in the side slots;

means for raising and lowering the center support pin along at least a portion of the length of the center slot.

18. A stretch forming press as claimed in claim 17 wherein the trunnions are at about the same elevation as the elevation of the side slots.

19. A stretch forming press as claimed in claim 17 wherein the center of mass of the jaw assembly is at about the axis of the trunnions.

20. A stretch forming press as claimed in claim 17 wherein the means for raising and lowering the center support pin comprises:

a center support pin carriage slidably mounted on the jaw frame at a position rearward of the afforded slidable vertical movement adjacent the length of the center slot, said center support pin carriage rotatably engaging the center support pin; and a hydraulic cylinder mounted on the jaw frame at a position above the center support pin carriage, the piston rod of the hydraulic cylinder extending downwardly to the center support pin carriage and being connected thereto.

21. A stretch forming press as claimed in claim 17 wherein the side support pins extend rearwardly from the jaws at locations which substantially minimize the change in the center of pull of the jaw when the center support pin is raised or lowered along the length of the center slot.

22. A stretch forming press as claimed in claim 17 further comprising means for independently rotating the jaw segments at the lateral ends of the jaw relative to their adjacent jaw segments.

23. A stretch forming press as claimed in claim 17 further comprising a hold-down bar removably secured to the frame extending across the tops of the jaw segments to prevent upward movement of the jaw segments.

24. A stretch forming press as claimed in claim 17 further comprising a jaw angle assembly for rotating the jaw assembly about the axis of the trunnions comprising:

a generally vertical track attached to one of the jaw carriages at a location spaced-apart rearwardly from the trunnion of the jaw frame which is engaged with that jaw carriage;

a sled slidably secured in the track and afforded vertical movement therein;

means for raising and lowering the sled along the length of the track;

a bracket mounted on the jaw frame at a position spaced-apart forwardly from the sled;

a linkage having forward and rearward ends extending between the bracket and the sled;

means for pivotally connecting the forward end of the linkage to the bracket;

means for pivotally connecting the rearward end of the linkage to the sled; and wherein downward movement of the sled results in rotation of the jaw assembly in one direction and upward movement of the sled results in rotation of the jaw assembly in the opposite direction.

25. A stretch forming press as claimed in claim 24 wherein the linkage is generally horizontal when the jaw assembly is in a horizontal orientation.

26. A jaw assembly for a stretch forming press having a pair of laterally spaced-apart jaw carriages comprising;

a jaw frame comprising:

a horizontally elongated front wall having a generally vertical center slot and a generally vertical side slot on each side of the center slot;

an end wall extending forwardly from each lateral end of the front wall; and a pair of generally coaxial horizontal trunnions which extend laterally outwardly from separate end walls for rotatably engaging the jaw carriages;

a side mounting block mounted in each vertical side slot and afforded slidable vertical movement along the length of the side slot, each side mounting block comprising a generally horizontal slot;

means for adjusting the vertical position of each side mounting block along at least a portion of the length of the corresponding vertical side slot;

a flexible jaw mounted on the jaw frame comprising:

a plurality of jaw segment aligned in a row;

hinge means pivotally connecting adjacent jaw segments together;

a center support pin extending rearwardly from the center of the jaw through the center slot of the jaw frame;

means for slidably and rotatably securing the center support pin in the center slot;

a pair of side support pins extending rearwardly from the jaw at locations laterally spaced apart from and on separate sides of the center support pin into the horizontal slots of the side mounting blocks; and means for slidably and rotatably securing the side support pins in the horizontal slots of the side mounting blocks; and means for raising and lowering the center support pin along at least a portion of the length of the center slot.

* * * * *